US008783183B2

(12) United States Patent
Gaisbauer et al.

(10) Patent No.: US 8,783,183 B2
(45) Date of Patent: Jul. 22, 2014

(54) ACTIVE BODY

(75) Inventors: Rainer Gaisbauer, Schoenau (DE); Heinz Bannach, Schoenau (DE); Vikron Kadavanich, Bayerisch Gmain (DE); Martin Fegg, Schoenau (DE); Christian Wagner, Munich (DE)

(73) Assignee: Rheinmetall Waffe Munition GmbH, Ratingen (DE)

( * ) Notice: Subject to any disclaimer, the term of this patent is extended or adjusted under 35 U.S.C. 154(b) by 1573 days.

(21) Appl. No.: 11/727,869

(22) Filed: Mar. 28, 2007

(65) Prior Publication Data

US 2007/0266882 A1 Nov. 22, 2007

Related U.S. Application Data

(63) Continuation of application No. PCT/EP2005/008167, filed on Jul. 28, 2005.

(30) Foreign Application Priority Data

Sep. 28, 2004 (DE) ..... 10 2004 047 231

(51) Int. Cl.

| | |
|---|---|
| ***F42B 4/26*** | (2006.01) |
| ***C06D 3/00*** | (2006.01) |
| ***F42B 12/48*** | (2006.01) |
| ***C06B 45/12*** | (2006.01) |

(52) U.S. Cl.
USPC ..... 102/336; 102/334; 102/288

(58) Field of Classification Search
USPC ..... 102/334, 336, 288
See application file for complete search history.

(56) References Cited

U.S. PATENT DOCUMENTS

| | | | | |
|---|---|---|---|---|
| 2,210,871 | A * | 8/1940 | Boddicker | 149/96 |
| 3,938,444 | A * | 2/1976 | Foote et al. | 102/283 |
| 5,074,216 | A | 12/1991 | Dunne et al. | |
| 5,343,794 | A | 9/1994 | Andreotti et al. | |
| 5,397,236 | A | 3/1995 | Fegg et al. | |
| 5,435,224 | A | 7/1995 | Andreotti et al. | |
| 5,531,163 | A * | 7/1996 | Dillehay et al. | 102/288 |
| 5,565,150 | A | 10/1996 | Dillehay et al. | |
| 5,585,594 | A | 12/1996 | Pelham et al. | |
| 6,427,599 | B1 | 8/2002 | Posson et al. | |
| 6,578,492 | B1 | 6/2003 | Koch et al. | |
| 6,581,520 | B1 | 6/2003 | Koch et al. | |
| 6,675,716 | B1 | 1/2004 | Nadler | |

FOREIGN PATENT DOCUMENTS

| | | |
|---|---|---|
| DE | 26 14 196 | 10/1977 |
| DE | 40 07 811 A1 | 12/1993 |
| DE | 42 38 038 C1 | 6/1994 |
| DE | 42 44 682 A1 | 10/1995 |
| DE | 196 05 337 A1 | 8/1997 |
| EP | 0 309 097 | 3/1989 |
| EP | 0 665 415 A2 | 8/1995 |

(Continued)

*Primary Examiner* — Shuangyi Abu Ali
(74) *Attorney, Agent, or Firm* — Muncy, Geissler, Olds & Lowe, P.C.

(57) ABSTRACT

An active body is provided that includes at least one active mass block made of monobasic or polybasic high-energy materials such as a nitrocellulose mixture, for example, comprising approximately 60 percent nitroglycerin and 40 percent diethylene glycol dinitrate, which is provided with structures both on a surface and on an interior. In addition, the inner structures can be filled with an active mass substance. The ignition is triggered by a pyrotechnical primer composition, which initiates the active body, preferably from the inside.

12 Claims, 1 Drawing Sheet

(56) References Cited

FOREIGN PATENT DOCUMENTS

| | | | |
|---|---|---|---|
| GB | 2 266 944 | A | 11/1993 |
| GB | 2 300 035 | A | 10/1996 |
| GB | 2 327 116 | A | 1/1999 |
| JP | 2001-174196 | A | 6/2001 |
| WO | WO 00/58237 | | 10/2000 |
| WO | WO 00/58238 | | 10/2000 |

* cited by examiner

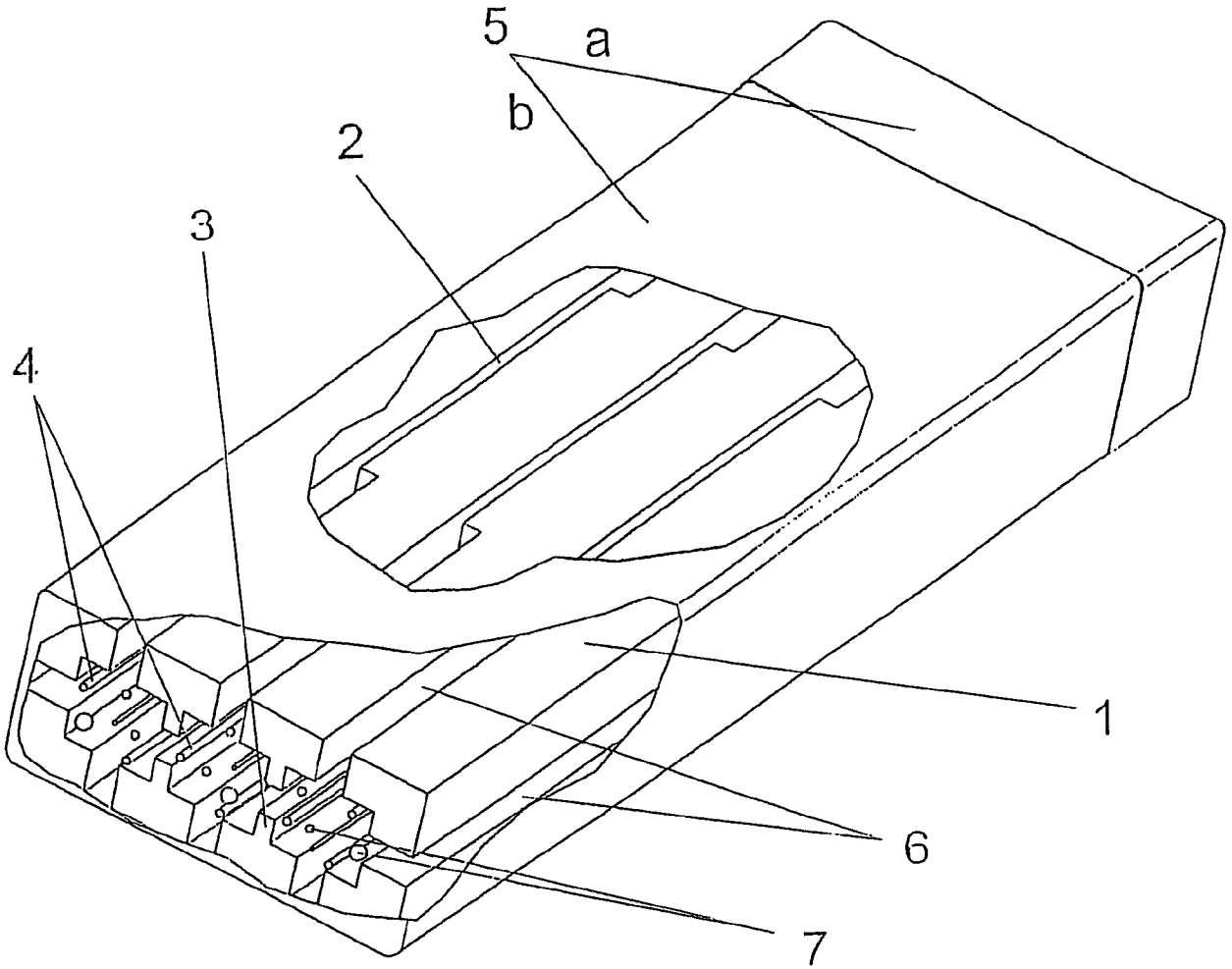
5
a
b
2
3
4
1
6
7

ACTIVE BODY

This nonprovisional application is a continuation of International Application No. PCT/EP2005/008167, which was filed on Jul. 28, 2005, and which claims priority to German Patent Application No. DE 102004047231, which was filed in Germany on Sep. 28, 2004, and which is herein incorporated by reference.

BACKGROUND OF THE INVENTION

1. Field of the Invention

The present invention relates to an active body.

2. Description of the Background Art

Active bodies for the protection of military objects, for example, aircraft, from infrared-guided missiles are known. In the most primitive case, they are pyrotechnically generated heat sources, which emit hot radiation.

An infrared decoy target is disclosed in DE 40 07 811 C2. It has a spectral distribution of an infrared emission of only moderately warm targets. For the decoy target, zeolite powder is used, which is suitable for absorbing air moisture. It can be used for coating a body, or as a finely-distributed cloud of powder particles, which float in the air. Basically, all types of zeolite, or powders of similar crystal structure, can be used.

Another infrared decoy target is known from the publication JP-A-2001-1741 96.

An infrared radiation device of incendiary composition, which is in direct contact with a metal foil, is described in DE 26 14 196 A1. In an embodiment, the incendiary composition is comprised of an inert mixture of potassium nitrate and metallic boron. The incendiary composition is attached to a metal foil with a nitrocellulose binder material.

In DE 42 44 682 A1, which corresponds to U.S. Pat. No. 5,585,594, a high-intensity, pyrotechnic infrared decoy flare is disclosed. Its purpose is to lure an incoming missile away from the aircraft. The decoy flare comprises a compactly clustered substantially void free array of discrete pieces of a gassy high intensity infra-red emitting pyrotechnic composition contained in an air-tight container designed to rupture.

An infra-red decoy target for a helicopter is also described in GB 2 327 116 A. An additional infrared decoy is known from U.S. Pat. No. 5,343,794. Possible material compositions of such decoys can be found in U.S. Pat. No. 6,675,716 as well as U.S. Pat. No. 5,435,224 and U.S. Pat. No. 5,343,794. Pyrotechnic smokescreen units are described in WO 00/58237 A1 and WO 00/58238.

In DE 196 05 337 C2, a method for altering the spatial and temporal infrared structure of an aircraft based on the new generation of infrared-guided missiles with integrated flare protection systems is described. It is suggested to artificially alter the spatial infrared signature of an aircraft, not only in a narrow spatial area at the fuselage but across typical flight dimensions.

A further method for providing a decoy body is found in DE 42 38 038 C1, which corresponds to U.S. Pat. No. 5,397,236. It is characterized in that the active masses simulating the target body are brought into the position of the decoy body to be produced, and are decomposed there in such a manner that a spectral-spatial target signature of the object for a target homing head is generated.

SUMMARY OF THE INVENTION

It is therefore an object of the present invention to provide an active body, which against modern missiles has as an effective infrared decoy target, for example, for aircraft, an object-like spectral radiation signature having a high radiation intensity in the area of the plume radiation, which will last for the entire duration of the action starting at initial ignition; features a specific blossoming method with steep leading edges, and has a sufficiently long action period. Furthermore, the effectiveness should be undiminished even at high altitudes with reduced oxygen levels, and no efficiency loss should occur at high output speeds (due to flow effects).

Thus, an active body is provided that includes at least one active mass block of monobasic or polybasic high-energy materials with surface structures. Depending on the type of structure and its depth, this requires an enlargement of the surface, which allows control of speed, with which the active mass block disintegrates, and thus of the duration of effectiveness of the active body.

In an aspect, the active mass block can have one or a plurality of interior channels and/or cavities, which allow an afflux-protected initiation of the active mass block on the inside. In combination with metallic cover plates and protective film, for example, it is thus ensured that loss of infrared radiation at high afflux velocities, as experienced during ejection of the active body (active mass block) from the plane, are avoided. Furthermore, as a result of the gases in the channels produced during the combustion of the active mass, a jet effect is generated, which at the same time can be utilized for the actuation, and thus the kinematics of the active body (flares).

To optimize the duration of the action gas and temperature bridges are provided. These can be made with slots, perforation, and/or bores between the interior channels. With a selectable number, size, and arrangement of these bridges, as well as the remaining wall strength, a defined time control of the cross ignition to the outer surfaces is possible.

The specific blossoming behavior is preferably adjusted by filling the channels with, for example, fine-structured material of the same substance, but compared to the active mass block clearly higher surface to mass ratio. The steepness of the leading edge can hereby be increased by increasing the surface to mass ratio.

In an embodiment, the igniting of the active masses takes place inside the channels in the active mass block, by, for example, pyrotechnical primer charges. This ensures a spontaneous, flow-dependent ignition on the one hand, while on the other hand, interference radiation caused by the primer composition is suppressed.

In the way described above, a bi-spectral active body is constructed, which reacts sufficiently well to new sensors.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein the figure illustrates an active mass block.

DETAILED DESCRIPTION

In the figure, an active mass block is illustrated, which on its surface is provided with two structures, for example, in the form of grooves. On its inside, the active mass block 1 has one of, or a plurality of, channels and/or cavities 3 filled with active mass substances 4. This substance can be a fine-structured material of the same substance, but with a distinctly increased surface to mass ratio as compared to the active mass block 1. Suitable fine-structured materials are materials having a high incidence of radiation in the wavelength range, preferably between 4.1 to 4.6 μm, for example, a nitrocellulose mixture of about 60 percent nitroglycerine and 40 percent, diethylene glycol dinitrate. These active mass substances 4 can be in the form of sticks (about 0.2 to 3 mm in diameter), flakes, wafers, or granulate, and can be used in this form.

Furthermore, the active mass block 1 has an afflux protector 5, which in this embodiment is formed by a cover and/or protective cap 5*a* and a protective film 5*b*. Gas and temperature bridges, which are formed by slots, perforations, or bores, are identified with the reference numeral 6.

A pyrotechnical primer composition 7, which preferably is made of pulverized boron and potassium nitrate (at a ratio of about 50 percent boron to 50 percent potassium nitrate), is provided for the ignition. This primer charge 7 can thereby be used in a grain size of about 0.2 to 3 mm.

It is understood that the quantities and measurements stated in the embodiment (caliber 2"×1"×8") described above are beneficial ones not to be viewed as limitations. Especially with different calibers, adjustments must be made in order to meet the criteria sufficiently.

Experience has shown that the integration of only one active mass block 1 in the active body will meet the objective. However, it is also possible to combine a plurality of active mass blocks 1 to form one active body.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. An active body comprising:

at least one pyrotechnic active mass block having specific structures at or on a surface of the active body and in an interior of the active body, wherein said structures in said interior being formed of channels and/or cavities;

said channels and/or cavities being filled with fine structured materials formed of active mass substances which are initiated by primer compositions, wherein the structures on the surface, which are formed as grooves and/or roughened texture, enlarge the surface depending on a pattern and a depth of the structures, and wherein the active mass block further comprises gas and/or temperature bridges between the channels or cavities in the interior of said active mass block, the gas and/or temperature bridges being formed by slits, perforations and/or bores.

2. The active body according to claim 1, wherein the active mass block and the active mass substances have an incidence of radiation in the wave length range of 4.1 to 4.6 μm.

3. The active body according to claim 1, wherein the active mass block and the active mass substances are made of monobasic or polybasic materials.

4. The active body according to claim 3, wherein a nitrocellulose mixture is used.

5. The active body according to claim 4, wherein the nitrocellulose mixture comprises nitroglycerine and diethylene glycol dinitrate.

6. The active body according to claim 1, wherein the active mass block includes afflux protection.

7. The active body according to claim 6, wherein the afflux protection is formed of a protective cap and a protective film.

8. The active body according to claim 1, wherein the active mass substances have a higher surface to mass ratio than the active mass block.

9. The active body according to claim 8, wherein the active mass substances are formed as sticks, flakes, wafers, or granulates.

10. The active body according to claim 9, wherein the sticks have a diameter of about 0.2 to 1.5 mm.

11. The active body according to claim 1, wherein the active mass substances are ignited by pyrotechnic primer compositions within the interior structure.

12. The active body according to claim 11, wherein the pyrotechnical primer compositions comprise pulverized bore and/or potassium nitrate at a mixing ratio of 50:50, and a grain size of 0.2 to 3 mm.

* * * * *